US005482338A

United States Patent [19]

Hall

[11] Patent Number: 5,482,338

[45] Date of Patent: Jan. 9, 1996

[54] GOLF BALL RETRIEVER

[76] Inventor: Norman E. Hall, 60 W. Richie Rd., Gladwin, Mich. 48624

[21] Appl. No.: 68,832

[22] Filed: May 28, 1993

Related U.S. Application Data

[63] Continuation of Ser. No. 837,149, Feb. 19, 1992, abandoned.

[51] Int. Cl.[6] ..... A63B 47/02

[52] U.S. Cl. ..... 294/19.2; 56/400.11

[58] Field of Search ..... 294/19.2, 52, 55, 294/55.5, 66.1; 37/119, 120; 56/332, 400.01, 400.04–400.09, 400.11, 400.12; 273/32 F, 162 E

[56] References Cited

U.S. PATENT DOCUMENTS

| | | | |
|---|---|---|---|
| 228,631 | 6/1880 | Hand | 37/120 |
| 280,667 | 7/1883 | P'Pool et al. | 56/400.07 X |
| 1,014,250 | 1/1912 | Norman | 56/400.11 |
| 1,095,585 | 5/1914 | Mack | 294/55 X |
| 1,141,423 | 6/1915 | Simas | 37/120 X |
| 2,270,632 | 1/1942 | Hasty | 294/19.2 |
| 2,738,214 | 3/1956 | Zimmers | 294/19.2 |
| 4,968,079 | 11/1990 | Burton | 294/19.2 |
| 5,110,168 | 5/1992 | Petrillo | 294/19.2 |

*Primary Examiner*—Dean Kramer

[57] ABSTRACT

A golf ball retriever including an elongated handle and a retriever head formed by an array of rigid curved fingers forming a rear facing trough, each finger having a lower section disposed horizontally with the handle held at about a 30 degree angle to the ground. The finger rips are downwardly inclined slightly with a ramp surface aiding capture of a golf ball as the retriever head is swept through mud or water with manipulation of the handle.

8 Claims, 2 Drawing Sheets

GOLF BALL RETRIEVER

This is a continuation of application Ser. No. 07/837,149 filed on Feb. 19, 1992, now abandoned

BACKGROUND OF THE INVENTION

This invention concerns golf ball retrievers adapted to retrieve lost golf balls from water hazards and muddy locations.

There have previously been conceived various such devices, most of which are impractical in situations where the ball attempted to be retrieved is not within view.

There have thus been conceived rake like retrievers intended to alleviate the problems involved in retrieving a golf ball from water and/or mud. See U.S. Pat. Nos. 2,738,214; 4,635,987; 4,730,859; 3,437,368; 4,411,463; and 4,645,254 for examples of these designs. However, such devices heretofore proposed have either not provided an effective "capture" of the golf ball allowing convenient retrieval or a configuration allowing effective use in mud.

U.S. Pat. No. 4,254,981 shows a rake like retriever which has rearwardly curved fingers arranged in a fan shape which are intended to capture the golf balls when the fingers encounter the golf ball.

However, it has been found that in use, the tips of the fingers are usually extended upwardly when the handle is held in a natural position, tending to push any ball encountered by the fingers ahead of the device rather than being trapped.

Furthermore, the fingers are long and constructed of relatively thin metal so as to be flexible and are too compliant to be easily forced through mud to retrieve a lost ball.

The present invention has the object of providing a golf ball retriever which is easy to use so as to very effectively capture a golf ball hidden in water and/or mud, which is particularly effective in dragging mud bottoms of ponds and other water hazards.

Another object is to provide such a device which is simple and rugged.

SUMMARY OF THE INVENTION

The present invention provides a golf ball retriever comprised of a head portion having a series of short, rigid fingers secured together in a parallel array by being fixed to cross piece. The tip of each finger is curved back reversely to form a collecting hook shape.

The cross piece is mounted to an elongated handle preferably of a telescoping design. The mounting is at an angle to the handle so that the reversely extending finger tips are disposed approximately parallel to the ground surface when the handle is held naturally and swept over an area being searched.

The angled mounting and the rigidity of the fingers creates a very effective collecting action, particularly in heavy mud, as the balls when encountered have a marked tendency to be moved into the collecting shape, where they are securely retained while the retriever head is swung out of the water or mud after each sweep.

DETAILED DESCRIPTION

Figure 1:
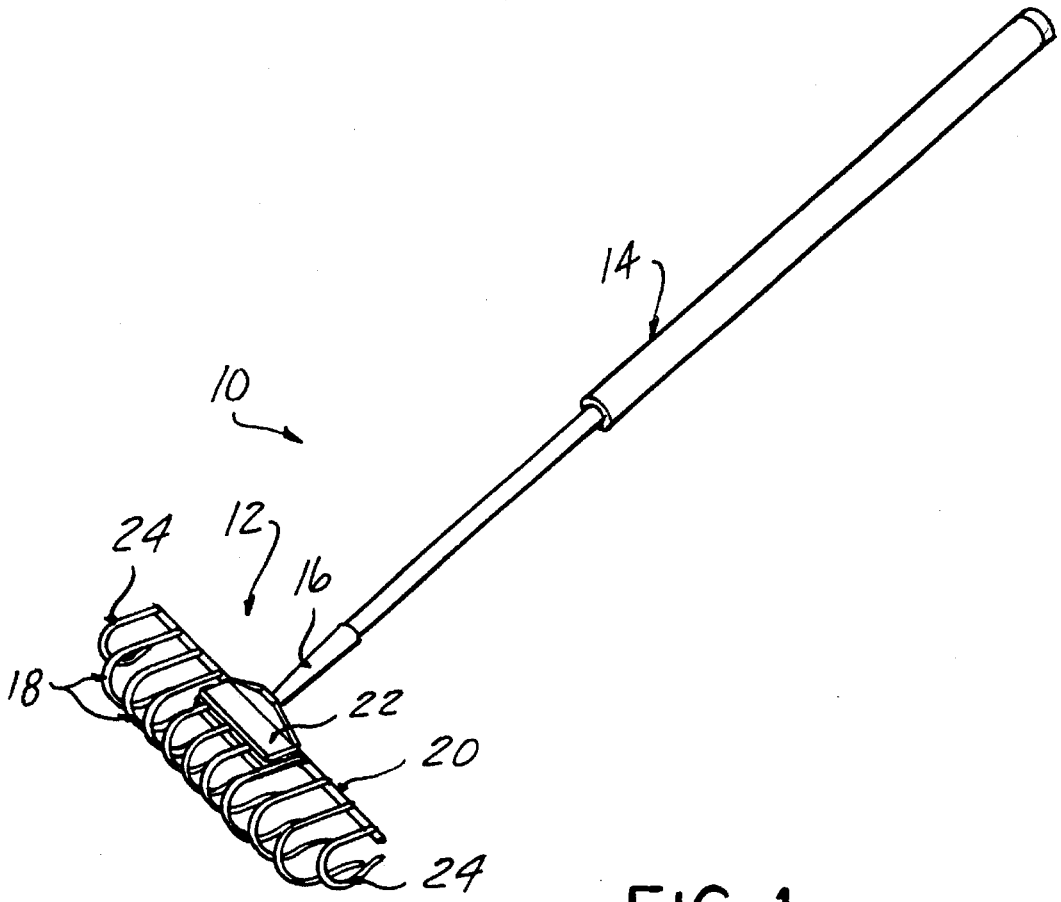
FIG. 1 is a perspective view of a golf ball retriever device according to the present invention, disposed in the approximate inclination existing when the device is in use.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the Drawings, the golf ball retriever device 10 according to the present invention includes a retriever head 12 detachably mounted to an elongated handle 14. The handle 14 is preferably of a telescopic design to enable convenient storage in a golf bag. The handle 14 is also preferably mounted to the retriever head 12 by means of a quick release connector 16 of well known design to allow ready disassembly as a further aid to convenient storage.

The retriever head 12 includes a parallel array of formed fingers 18 fixed together but spaced apart with a tip cross rod 20 welded to the underside of the top of each finger 18. The fingers 18 are preferably widely spaced in the array to create an open design, but sufficiently close to ensure that a golf ball cannot pass between the fingers 18, i.e., a spacing on the order of 1⅜ inches. A angled mounting bracket 22 clamped across the central fingers 18 enables securement of the quick-release connector 16.

The parallel array of fingers 18 extends transversely to the elongated handle 14, and a looped finger 24 is located at either end of the array, located within the perimeter of the adjacent formed fingers so as to act as an end confinement preventing the escape of any golf ball captured within the finger array.

Each finger 18 is formed with a forwardly extending curved upper section 26 and a lower, rearwardly extending end section 28. The tips 32 of the lower sections lie approximately below the beginning of the horizontal part of the upper section 26. Thus a rear facing partially cylindrical trough shape is created by the finger array. The inside of the trough is sized to allow a golf ball to freely move completely against the inside of the forward curved sections 26, i.e., a radius of 1/16 inches has been successfully employed.

Each end section 28 has a slight bottom curve 30 acting as a retaining feature, and slightly downwardly inclined tips 32. An angled surface 34 disposes a ramp surface on the tip 32 each finger 18.

The mounting bracket 22 establishes an angle between the direction in which the end sections 28 extend and the longitudinal axis of the handle 14 such that the finger end sections 28 extend approximately horizontally when the handle 14 is held naturally by a person using the retriever 10 to sweep an area in search of a lost ball. This preferred angle A has been determined to be about 30 degrees, since the handle 14 is typically extended at a relatively shallow angle to the ground in reaching over areas to be swept in the search for a lost golf ball.

The vertical dimension of the rearward facing gap between the top of each finger 18 and the respective end section 28 is also set to ensure that a golf ball 36 may easily pass into the interior of the partially cylindrical trough formed by the finger array.

Figure 4:
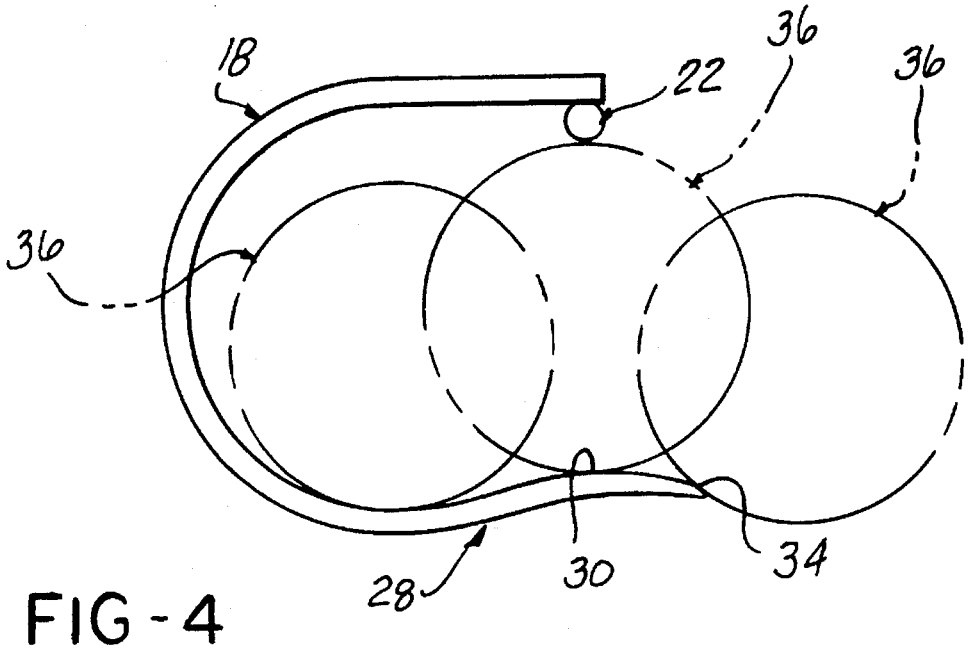
FIG. 4 is an enlarged side elevational diagram of a curved finger and golf ball illustrating the capturing action involved when the device is in use.
Figure 3:
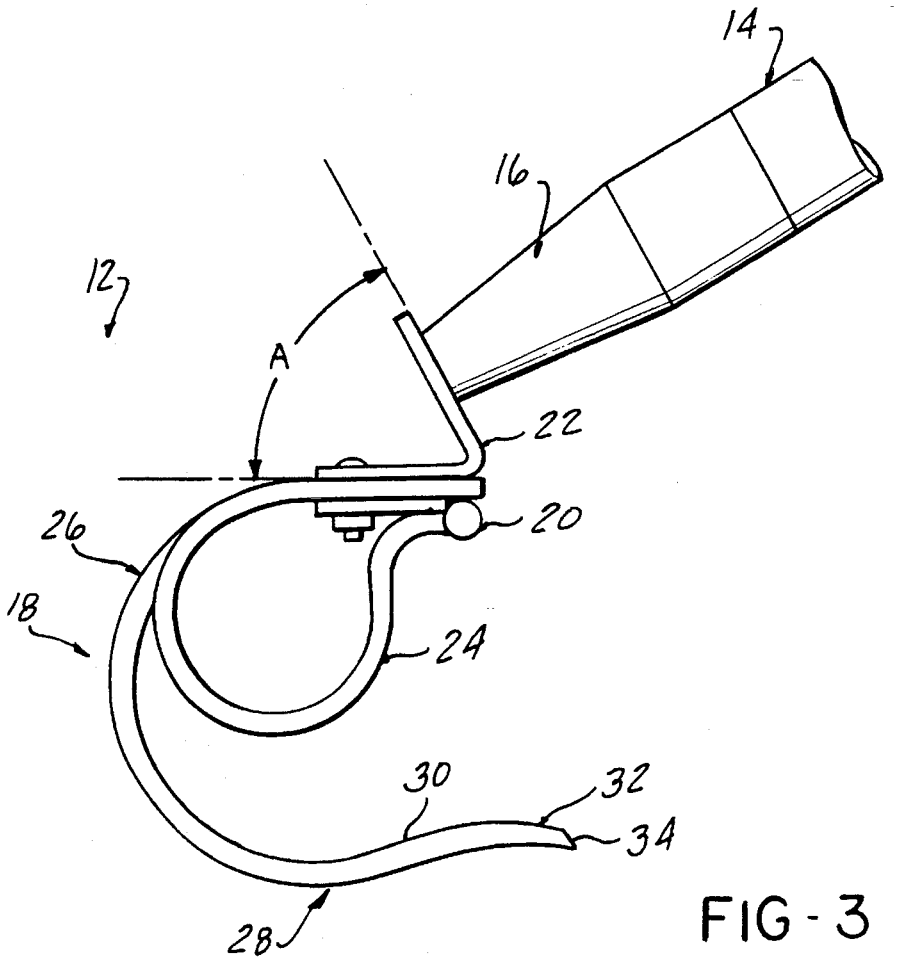
FIG. 3 is an enlarged side elevational view of the head portion of the retriever device shown in FIG. 1.
Figure 2:
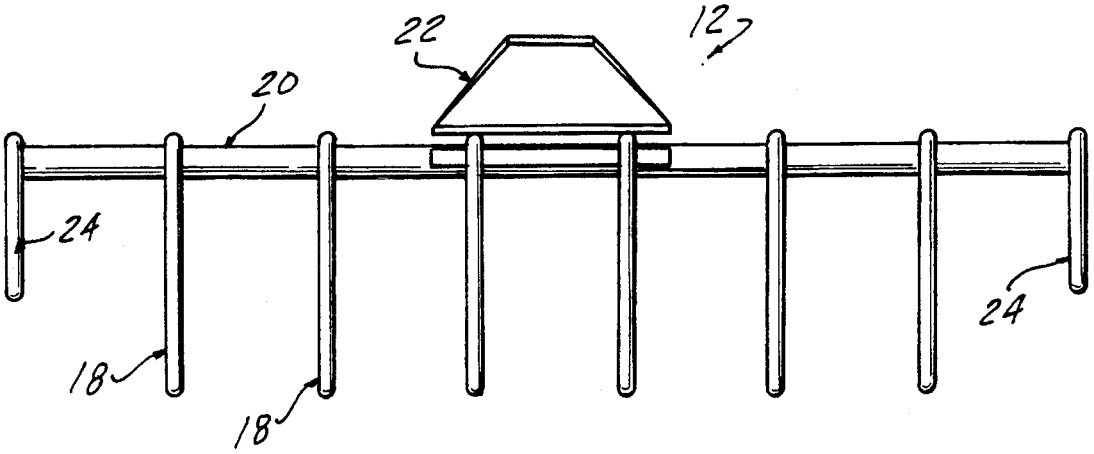
FIG. 2 is a plan view of the head portion of the device shown in FIG. 1.

This relationship creates a particularly effective capturing action as depicted in FIG. 4.

The downwardly curved end sections 28 and angled tips 32 tend to engage an encountered golf ball 36 at a very low point and in a manner tending to cause the golf ball 36 to pass up the end sections and into the slight trough created behind the curve 30. The angled mounting bracket 22 tends to cause the finger end sections 28 to be disposed in the generally horizontal direction when the handle 14 is held naturally to cause this result. This is in distinction to prior designs which tended to push the balls by contact with the upwardly tilted ends of the fingers.

The completely open design created by the fingers 18 connected only by the small diameter cross rod 20 facilitates movement of the retriever head 12 through water and particularly mud and separation out of the golf ball.

The fingers 18 are relatively short in length, i.e., only slightly longer than the golf ball itself and constructed of sturdy material, i.e., ⅛ inch stainless steel wire, so as to create rigid elements capable of being pulled through mud and debris without deflecting to separate out and capture any golf ball trapped therein.

The retriever head 20 can be made in various widths and still be effective. The illustrated embodiment is approximately of ten inches, using six fingers 18 and two end elements 24, but either fewer or more fingers can be incorporated and still be effective.

Thus a simple and rugged retriever has been provided which has been formed to be extremely effective for retrieving golf balls from water and mud hazards.

I claim:

1. A golf ball retriever adapted to retrieve golf balls buried in muck comprising:

an elongated handle;

a retriever head mounted to one end of said handle, said retriever head comprised of a parallel array of spaced apart substantially rigid fingers, said fingers spaced apart in said array a distance substantially smaller than the diameter of a golf ball to enable trapping of golf balls by said parallel array of fingers, each finger shaped with a forwardly extending upper section and a rearwardly extending lower end section, and a connecting intermediate curved section, said end section extending generally horizontally with said handle disposed at a substantial acute angle with respect to the ground;

a cross element extending across said upper section of each finger and fixed thereto to secure said fingers together, said fingers connected only by said cross element so that said intermediate and lower sections are unconnected and completely open and free from each other, said fingers being sufficiently rigid so that said unconnected lower and intermediate sections are to be self supporting during use in penetrating muck to retrieve golf balls, and further including a handle mounting bracket means fixed atop said upper section, said handle mounted by said mounting bracket means to extend at an upward acute angle with respect to the direction in which said lower sections of said fingers extend, whereby when said handle is held at said substantial acute angle, said lower sections extend generally horizontally.

2. A golf ball retriever according to claim 1, wherein said fingers generally form a rear facing generally cylindrical trough.

3. A golf ball retriever according to claim 2, further including end loops fixed on either side of said finger array formed in a smaller diameter than the curvature of said fingers to create an end confinement.

4. A golf ball retriever according to claim 1, wherein each of said lower sections terminate in a downward inclined end portion having a tip.

5. A golf ball retriever according to claim 4, said tips of each of said finger end sections are shaped with a downward ramp surface.

6. A golf ball retriever according to claim 5, wherein each of said tips are formed with a slight upward curve forward of said tip to create a slight trough within said finger end sections.

7. A golf ball retriever according to claim 4, wherein said upper sections have horizontal portions beginning at a point roughly over said end section tips.

8. A golf ball retriever according to claim 7, wherein said fingers are each formed of steel wire approximately ⅛ inch in diameter, to be substantially rigid to resist bending when drawn through mud.

* * * * *